US007089949B1

(12) United States Patent
Rogerson et al.

(10) Patent No.: US 7,089,949 B1
(45) Date of Patent: Aug. 15, 2006

(54) APPARATUS FOR MANEUVERING A DEVICE WITHIN THE INTERIOR OF STORAGE TANKS

(75) Inventors: R. Brian Rogerson, Virginia Beach, VA (US); Bobby H. Hux, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 561 days.

(21) Appl. No.: 10/421,454

(22) Filed: Apr. 17, 2003

(51) Int. Cl.
*B08B 9/00* (2006.01)

(52) U.S. Cl. ..... 134/167 R; 134/166 R; 134/166 C; 134/167 C; 239/227; 118/317

(58) Field of Classification Search ..... 118/317; 239/227; 134/167 R, 166 R, 167 C
See application file for complete search history.

(56) References Cited

U.S. PATENT DOCUMENTS 1,693,885 A * 12/1928 Butterworth ..... 134/168 R
2,763,964 A * 9/1956 Luce ..... 451/75
3,599,871 A 8/1971 Ruppel et al. ..... 239/227
3,612,441 A * 10/1971 Abramopaulos ..... 244/2
3,645,452 A * 2/1972 Stoeckel et al. ..... 239/227
3,741,808 A * 6/1973 Stalker ..... 134/58 R
4,220,170 A * 9/1980 Hebert et al. ..... 134/167 R
4,244,523 A 1/1981 Looper ..... 239/227
4,351,478 A * 9/1982 Looper ..... 239/227
4,463,413 A * 7/1984 Shirley ..... 362/401
4,574,825 A * 3/1986 Haug ..... 134/167 R
4,859,249 A * 8/1989 Valentini ..... 134/22.18
5,107,879 A 4/1992 Harvey ..... 134/167
5,195,548 A * 3/1993 Roger ..... 134/167 R
5,518,553 A * 5/1996 Moulder ..... 134/22.18
5,619,195 A * 4/1997 Allen et al. ..... 341/20
5,718,382 A 2/1998 Jaeger ..... 239/227
5,720,310 A * 2/1998 Moulder ..... 134/167 R
6,024,576 A * 2/2000 Bevirt et al. ..... 434/262
6,202,968 B1 * 3/2001 Lehr ..... 248/278.1
6,371,137 B1 * 4/2002 Heath ..... 134/167 R
6,418,948 B1 * 7/2002 Harmon ..... 134/168 R
6,561,199 B1 * 5/2003 Gleeson et al. ..... 134/22.18
6,655,397 B1 * 12/2003 Brown et al. ..... 134/167 R

* cited by examiner

*Primary Examiner*—Michael Barr
*Assistant Examiner*—Sarah E. Husband
(74) *Attorney, Agent, or Firm*—Michael P. Stanley

(57) ABSTRACT

An apparatus for attachment to a commercially available cleaning wand for maneuvering the wand inside a storage tank. Two arms each have an end pivotally connected to a handle and another end pivotally connected to the wand to form a four bar linkage. A gimbal arrangement is supported above a base, which is placed over an opening in the tank, and one of the arms is coupled to the gimbal arrangement to allow movement about three mutually perpendicular axes for directing the wand to various orientations within the tank.

7 Claims, 7 Drawing Sheets

APPARATUS FOR MANEUVERING A DEVICE WITHIN THE INTERIOR OF STORAGE TANKS

STATEMENT OF GOVERNMENT INTEREST

The invention described herein may be manufactured and used by or for the Government of the United States of America for government purposes without the payment of any royalties therefor.

BACKGROUND OF THE INVENTION

Various storage tanks, including rail car tanks and other vessels require periodic inspection and internal cleaning to remove fluid or debris built up on the interior tank wall. For example, the tank is cleaned through a manway, or opening, with a lancing, or cleaning wand which is supplied with high-pressure fluid. To clean or inspect the interior an operator generally holds the inspection equipment or cleaning wand through the opening while laying on a personnel platform. If such a platform is not part of the tank structure, a portable staging platform is erected for this purpose.

This method of cleaning the tank is cumbersome and uncomfortable for the operator. Further, it is difficult for the operator to hold and direct the cleaning wand while in the prone position. The present invention eases the cleaning operation, allowing it to be done with less effort and in a shorter period of time. Further, for inspection purposes, the present invention allows for easy, controlled inspection of the tank interior.

SUMMARY OF THE INVENTION

The present invention includes an apparatus for maneuvering a device such as a cleaning wand supplied with high-pressure fluid for cleaning the interior of a storage tank, the tank having an opening through which the wand is inserted. The apparatus includes a base with an outer gimbal ring disposed above the base and a plurality of legs connecting the outer gimbal ring with the base. First and second shafts connect an inner gimbal ring with the outer gimbal ring in a manner to permit oscillation of the inner gimbal ring about a first axis.

A sleeve is positioned within the inner gimbal ring with third and fourth shafts connecting the sleeve with the inner gimbal ring in a manner to permit oscillation of the sleeve about a second axis perpendicular to the first axis. First and second pivotal connectors are positioned at spaced apart locations on a handle member with a first arm having a first end being connected to the first pivotal connector and passing through the sleeve. A second arm having a first end is connected to the second pivotal connector. A swivel bushing surrounds and is secured to the first arm and is positioned on top of the sleeve to permit rotation of the first arm about a vertical axis.

Third and fourth pivotal connectors are positioned at respective second ends of the first and second arms for connection to the device.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
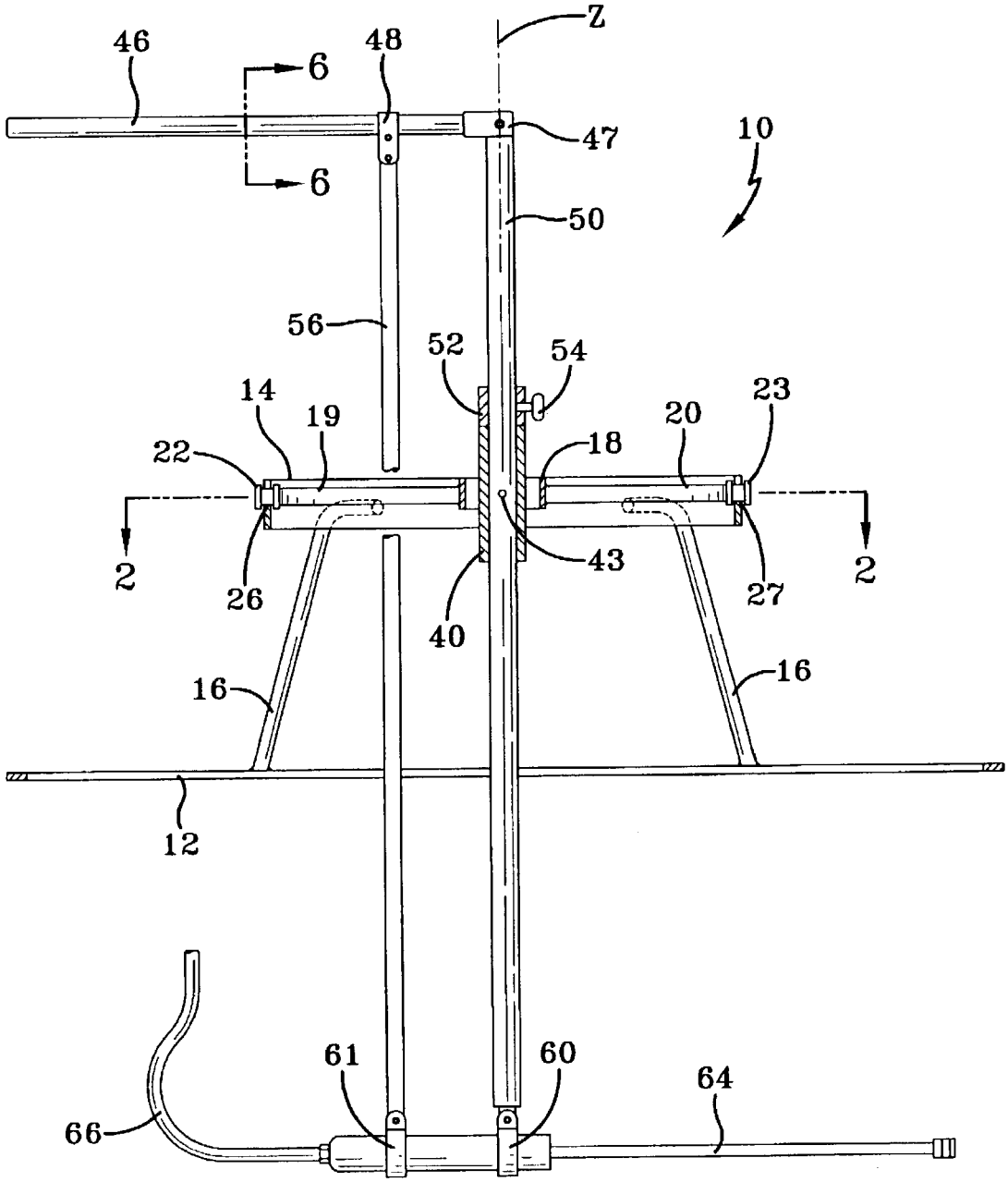
FIG. 1 is a side view, partially in section, of one embodiment of the present invention.

In the drawings, which are not necessarily to scale, like or corresponding parts are denoted by like or corresponding reference numerals. Although the apparatus is applicable to various devices including inspection cameras and other viewing gear, it will be described, by way of example, with respect to cleaning equipment.

Figure 2:
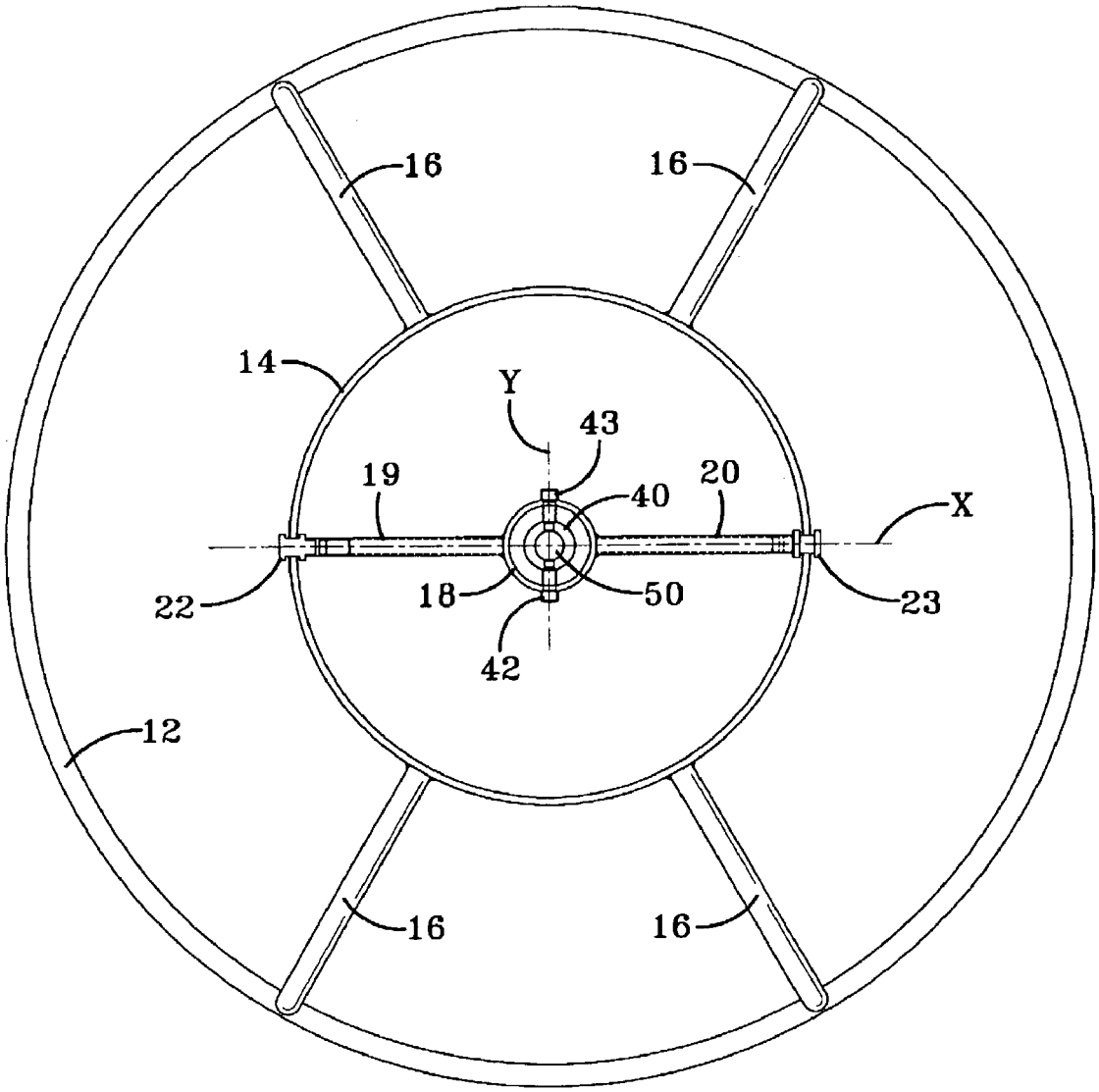
FIG. 2 is a view along the line 2—2 of FIG. 1.

Referring now to FIGS. 1 and 2, the cleaning apparatus 10 includes a base member 12 and an outer gimbal ring 14 supported above the base 12 by a plurality of legs 16. An inner gimbal ring 18 is connected to the outer gimbal ring 14 by respective first and second shafts 19 and 20 in a manner to permit oscillation of the inner gimbal ring 18 about a first axis X.

Figure 2A:
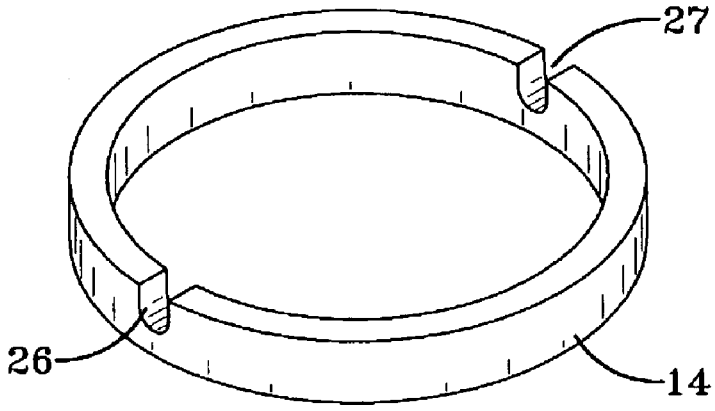
FIG. 2A illustrates a gimbal ring of FIGS. 1 and 2 in more detail.
Figure 2B:
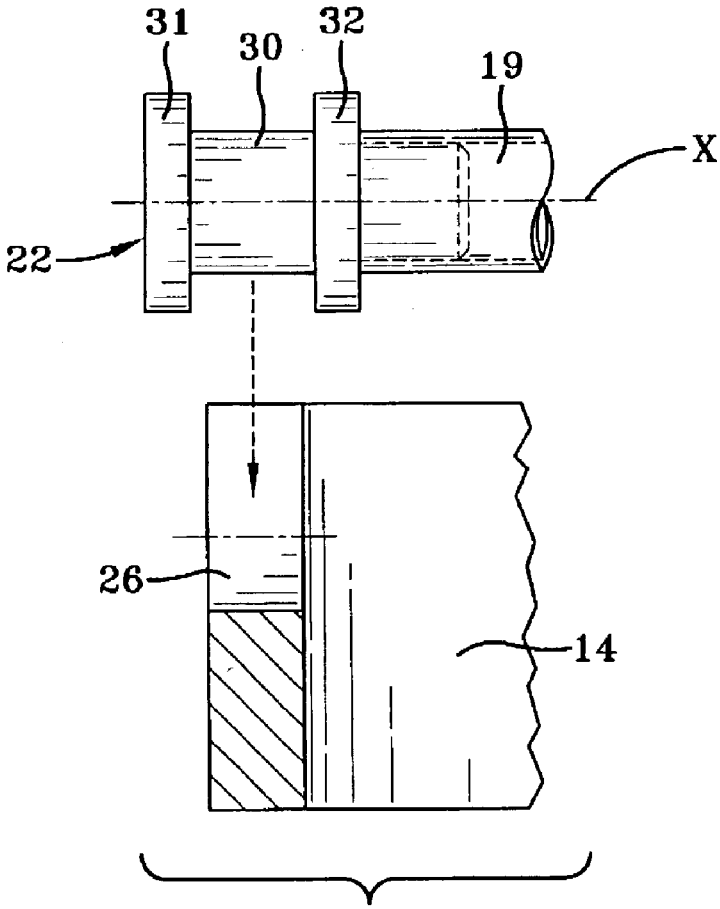
FIG. 2B illustrates an end member in more detail.

More particularly, and in a preferred embodiment, each shaft 19 and 20 includes a respective end member 22 and 23 which reside, and are rotatable in, respective diametrically opposed notches 26 and 27 of the outer gimbal ring 14, best illustrated in FIG. 2A. A typical end member 22 is illustrated in FIG. 2B. The end member 22 includes a central cylindrical portion 30 straddled by opposed flanges 31 and 32. Central cylindrical portion 30 may oscillate in the notch 26 about axis X, while flanges 31 and 32 limit axial movement of shaft 19. This same structure and operation also describes end member 23 residing in notch 27. The shafts 19 and 20 may be metal pipes and the end members 22 and 23 may be of a hard durable plastic material.

Referring once again to FIGS. 1 and 2, the apparatus includes a sleeve 40 positioned within the inner gimbal ring 18 and connected to the inner gimbal ring 18 by means of respective third and fourth shafts 42 and 43 in a manner to permit oscillation of the sleeve 40 about a second axis Y, perpendicular to first axis X. The third and fourth shafts 42 and 43 may be constituted by shoulder bolts passing through respective apertures in inner gimbal ring 18 and threaded to sleeve 40.

The apparatus utilizes a linkage comprised of a handle 46 having first and second pivotal connectors 47 and 48 positioned at spaced apart locations on the handle 46. In the embodiment illustrated, the first pivotal connector 47 is located at an end of the handle 46. Depending from the first pivotal connector 47 is a first arm 50 which passes through the sleeve 40 as well as a swivel bushing 52 secured to arm 50 by means of, for example, a thumbscrew 54. The swivel bushing 52 rests on, and is rotatable relative to, the top of the sleeve 40, thus permitting rotation of the arm 50 about a vertical axis Z.

A third component of the linkage is comprised of a second arm 56 which is connected to the second pivotal connector 48 and remains parallel to the first arm 50 during operation. Positioned at respective second ends of arms 50 and 56 are third and fourth pivotal connectors 60 and 61 for connection to a commercially available lancing, or cleaning wand 64, which is supplied with high pressure fluid via flexible hose 66. When attached, the cleaning wand 64 completes a four bar linkage, along with handle 46 and arms 50 and 56, for leverage and motion maneuverability of the wand. The handle 46 and first and second arms 50 and 56 are preferably hollow tubes.

Figure 3A:
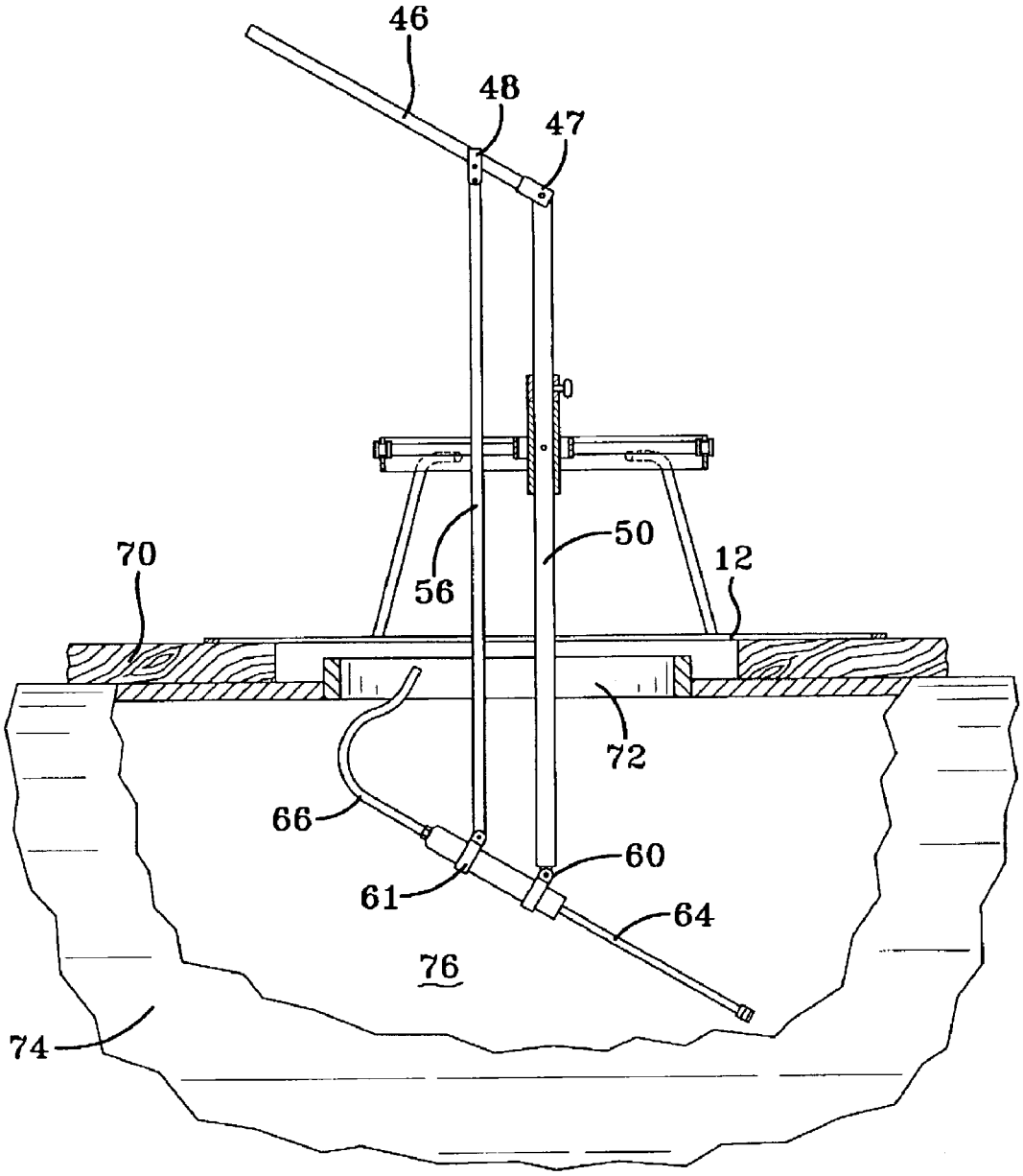
FIGS. 3A and 3B are views of the apparatus in two different orientations.
Figure 3B:
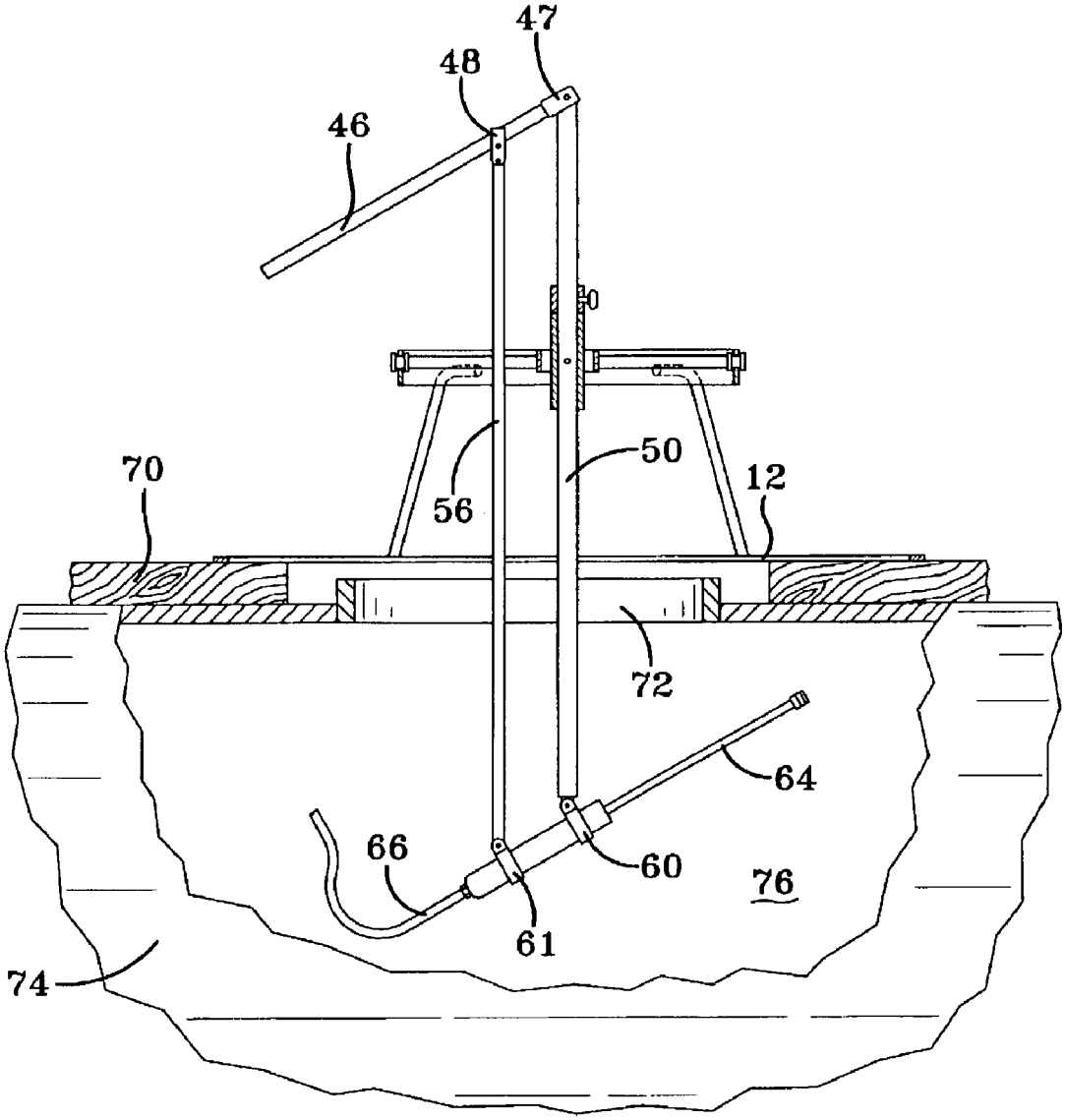

For example, FIGS. 3A and 3B illustrate the apparatus placed on a support platform 70 over a manway, or opening 72, of a storage tank 74, having an interior 76. With the four bar linkage, when the handle 46 is raised, the cleaning wand 64 is directed to a downward position. Conversely, and as indicated in FIG. 3B, when the handle 46 is depressed, the cleaning wand 64 is directed to an upward position. Handle 46 is also utilized to rotate the linkage around approximately 180°, and to this end reference is made to FIG. 4.

Figure 4:
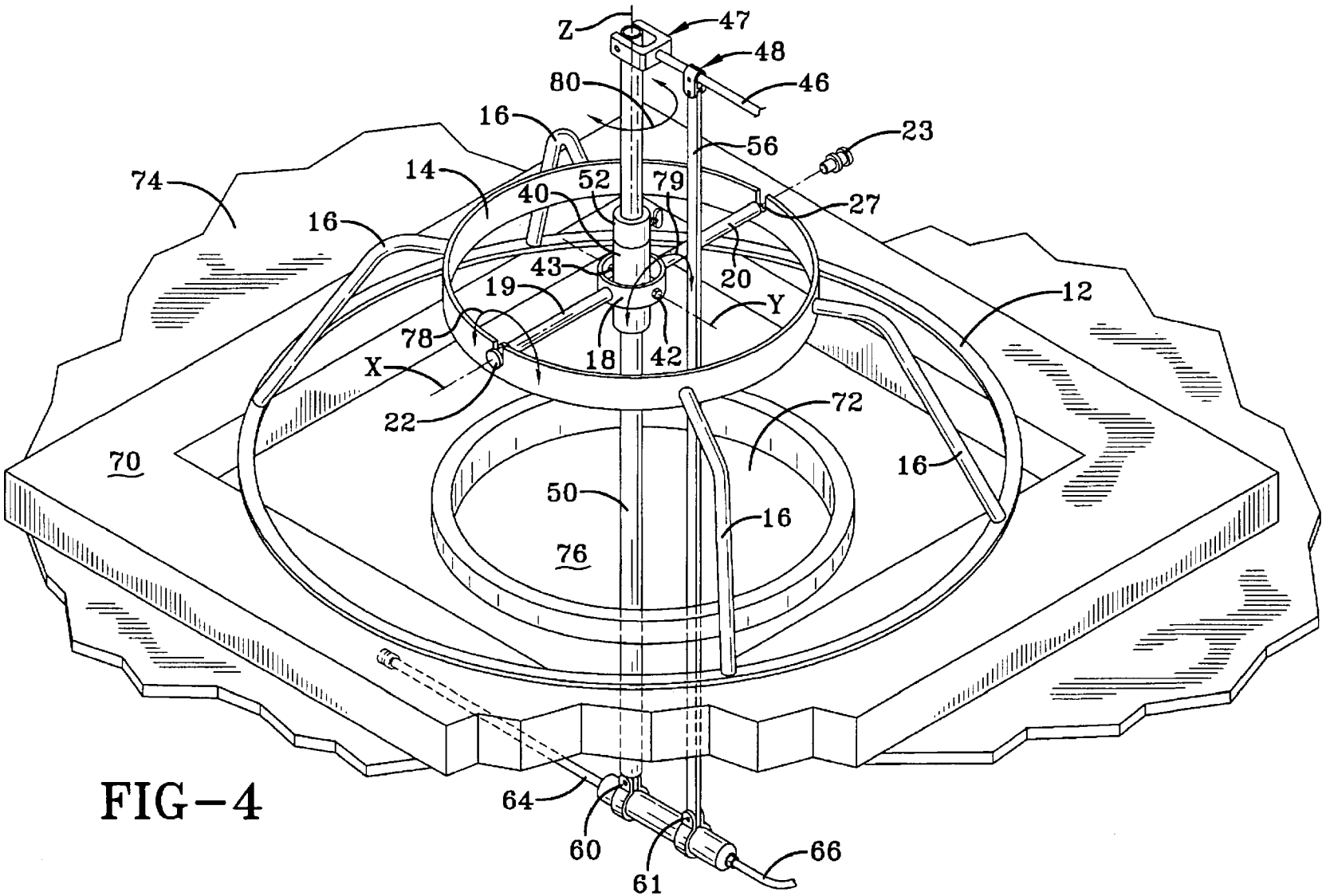
FIG. 4 is a perspective view of the apparatus over an opening in a tank.

FIG. 4 is a view of the apparatus on the support platform 70, and illustrates the cleaning wand 64 in the interior 76 of the storage tank 74. By manipulating the handle 46 (partially shown in FIG. 4), shafts 19 and 20 may be oscillated in the direction of arrow 78, about the X axis. Further, sleeve 40 may be oscillated in the direction of arrow 79, about the Y axis, and in addition, arm 50 may be rotated for limited movement of approximately 180° about the Z axis, as indicated by arrow 80. That is, arm 50 may be rotated between the limits wherein arm 56 encounters shaft 19 at one extreme and shaft 20 at the other extreme. Therefore, the arrangement provides for the cleaning coverage of approximately one half of the tank interior walls. After a cleaning operation with the apparatus placed as illustrated in FIG. 4, the base 12 may be physically rotated, one or more times, such that the remaining coverage may be accomplished.

Figure 5:
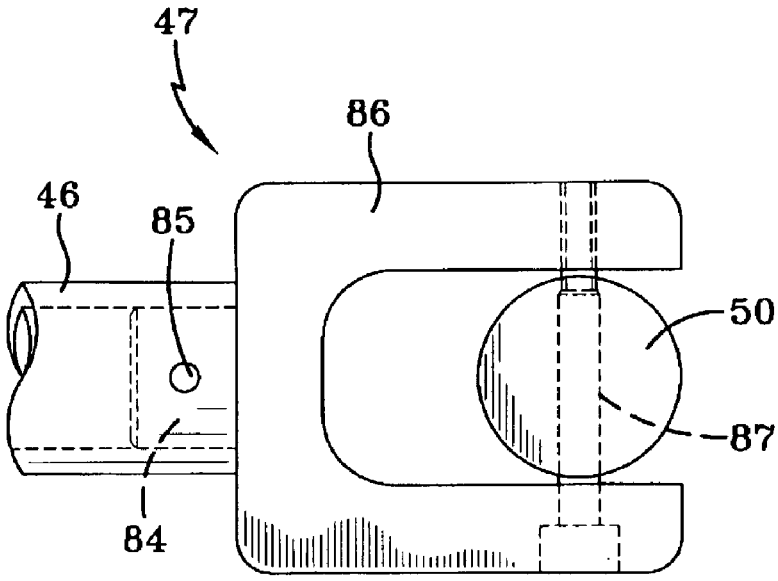
FIG. 5 is a plan view of a pivotal connector utilized herein.

Various pivotal connector designs may be used herein and FIG. 5 illustrates one such connector 47 for arm 50. Pivotal connector 47 is a clevis having a shank 84 inserted within handle 46 and secured to it by a pin 85. The U-shaped end 86 of the clevis accommodates the first arm 50 which is free to pivot about a pin such as a shoulder bolt 87.

Figure 6:
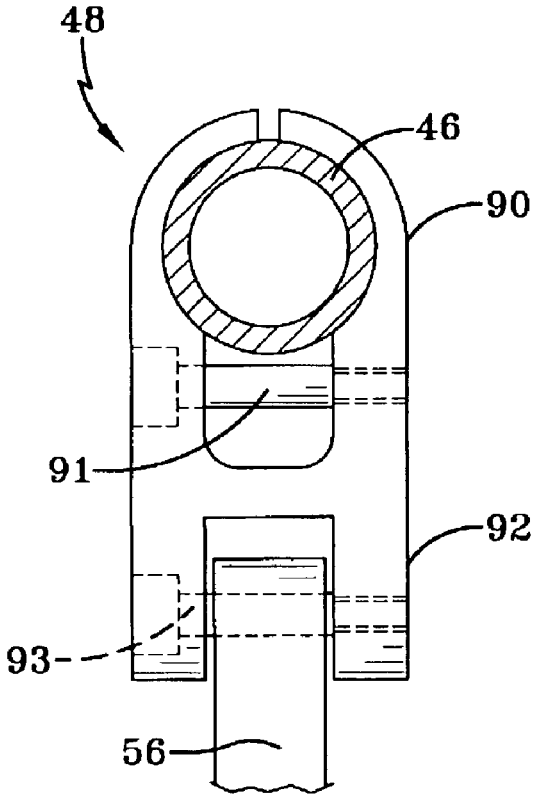
FIG. 6 is a view along the line 6—6 of FIG. 1.

FIG. 6 illustrates one type of pivotal connector for second arm 56. Connector 48 includes an upper portion 90 which is clamped around the handle 46 and secured in place by means of bolt 91. A U-shaped lower portion 92 accommodates the arm 56 which is free to pivot about a pin such as a shoulder bolt 93. Pivotal connectors 60 and 61 for the cleaning wand may be of a design such as illustrated in FIG. 6, or may be of any design which allows for the pivotal movement of the linkage system.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. An apparatus for maneuvering a cleaning wand within an interior of a storage tank by an opening of the storage tank, said apparatus comprising:

a base positionable on the storage tank and over the opening of the storage tank;

an outer gimbal ring disposed above said base;

a plurality of legs supporting said outer gimbal ring with said base;

an inner gimbal ring encompassed by said outer gimbal ring;

first and second shafts connecting said inner gimbal ring with said outer gimbal ring in a manner to permit oscillation of said inner gimbal ring about a first axis;

a sleeve positioned within said inner gimbal ring;

third and fourth shafts a connecting said sleeve with said inner gimbal ring in a manner to permit oscillation of said sleeve about a second axis perpendicular to the first axis;

a handle;

first and second pivotal connectors positioned at spaced apart locations on said handle;

a first arm having a first end connected to said first pivotal connector with said first arm passing through said sleeve;

a second arm having a first end connected to said second pivotal connector;

a swivel bushing surrounding and secured to said first arm and positioned on top of said sleeve to permit rotation of said first arm about a vertical axis as a third axis;

third and fourth pivotal connectors positioned at respective second ends of said first and second arms for connection to said cleaning wand.

2. The apparatus according to claim 1 wherein said outer gimbal ring includes diametrically opposed notches and said first and second shafts include respective end members which rest in respective ones of said notches.

3. The apparatus according to claim 2 wherein each of said end members has a central cylindrical portion straddled by opposed flanges, said flanges limiting axial movement of said first and second shafts.

4. The apparatus according to claim 2 wherein said end members comprise a plastic material.

5. The apparatus according to claim 1 wherein said swivel bushing is secured to said first arm by means of a thumbscrew passing through a wall of said swivel bushing.

6. The apparatus according to claim 1 wherein said handle and said first and second arms are hollow tubes.

7. The apparatus according to claim 1 wherein said first pivotal connector is positioned at an end of said handle.

* * * * *